United States Patent [19]

Meyn

[11] Patent Number: 4,494,364

[45] Date of Patent: Jan. 22, 1985

[54] APPARATUS FOR PACKING FOWLS IN PLASTIC BAGS

[76] Inventor: Pieter Meyn, P.P. Box 16, 1510 AA Oostzaan, Netherlands

[21] Appl. No.: 550,717

[22] Filed: Nov. 10, 1983

Related U.S. Application Data

[63] Continuation of Ser. No. 256,561, Apr. 22, 1981, abandoned.

[30] Foreign Application Priority Data

Apr. 25, 1980 [NL] Netherlands ..... 8002379

[51] Int. Cl.[3] ..... B65B 5/04; B65B 7/12

[52] U.S. Cl. ..... 53/570; 53/370; 53/572

[58] Field of Search ..... 53/138 A, 570, 572, 53/370

[56] References Cited

U.S. PATENT DOCUMENTS

| | | | |
|---|---|---|---|
| 443,550 | 12/1890 | Stevens | 53/370 X |
| 533,516 | 2/1895 | Williams | 53/370 X |
| 2,744,370 | 5/1956 | Seragnoli | 53/227 |
| 2,924,924 | 2/1960 | Garapolo | 53/370 X |
| 2,946,166 | 7/1960 | Baxter | 53/570 |
| 3,369,341 | 2/1968 | Niedecker | 53/138 A |
| 3,811,245 | 5/1974 | Mosterd | 53/370 X |
| 3,864,894 | 2/1975 | Sheetz | 53/571 |
| 3,971,191 | 7/1976 | Hoyland | 53/572 X |
| 4,147,012 | 4/1979 | Van Mil | 53/572 X |

*Primary Examiner*—John Sipos

*Attorney, Agent, or Firm*—Dority & Manning

[57] ABSTRACT

An apparatus for packing fowl in plastic bags. The machine has a magazine holding a stack of plastic bags, a funnel and a plunger for pushing a bird through the funnel into the top most bag in the magazine, which has been blown open and mechanically put onto the narrow end of the funnel. The machine further comprises a clamp for holding the bagged bird, pincers for grabbing and holding the open end of the bag and a slotted counter pressure plate for sliding over the end of the bag between the clamp and the pincers. After bagging the bird the pincers pull the bag tight over the bird, which is held back by the plate, after which the clamp and the plate together make an adjustable number of revolutions relative to the pincers to twist the bag. Finally the clamp, the plate and the pincers are moved together to a tieing unit which automatically ties the bag with tape or a metal clip.

7 Claims, 4 Drawing Figures

APPARATUS FOR PACKING FOWLS IN PLASTIC BAGS

This application is a continuation of Ser. No. 256,561 filed 4/22/81 now abandoned.

BACKGROND OF THE INVENTION

The invention relates to an apparatus for packing fowl in plastic bags, in which an axially movable plunger pushes a bird through a funnel into a plastic bag held in a magazine, which has been blown open and put onto the end of the funnel, and in which the bird together with the bag, is pressed against an abutment surface, so that the bird's legs are folded back against its body in the bag, after which the bag may be closed and tied.

Processed birds, which are to be frozen, are normally packed in plastic bags. Since air has insulating properties it is important that as little air as possible is entrapped in the bags, to save energy when freezing the birds. Apart from that the entrapped air may have a detrimental effect on the shelf life of the birds. It is also important the the birds look appetizing, which means that the bags should have no folds or wrinkles, and that the birds should remain neatly folded in their bags.

For these reasons the birds, which have first been sorted according to size, are in practice put into very tight bags, and different sizes of bags are used for different sizes of birds.

It has been proposed to remove the air from the bags by means of vacuum before the bags are closed and tied, but this involves an additional operation, which means additional costs. It also involves the use of a strong and often heat shrinkable bag material, which means even more additional costs. Therefore, in practice this method is only used when the birds are frozen in a brine freezer or another type of liquid freezer, after the birds have been packed.

The known apparatuses for packing birds have the disadvantage, that they cannot pack the birds as tightly as can be done by hand. The most difficult part is not putting the birds into the bags, but to close, tighten and tie the bags, which in practice is still done by hand, even when the birds have been put into the bags by a machine.

SUMMARY OF THE INVENTION

The main object of the invention is to overcome these disadvantages and to provide an apparatus, which will pack birds as tightly as can be done by hand.

According to the invention, this object is realized by providing an apparatus of the type defined with a clamp, which will grasp and hold the bag after the bird has been pushed into it by the plunger, and pincers, which will close and hold the open end of the bag after withdrawal of the plunger, after which the clamp is caused to rotate about the longitudinal axis of the bag relative to the pincers, so that the bag is tightened and twisted, and finally the bag is tied by means of tape or a metal clip and released by the clamp and the pincers.

Preferably the clamp and the pincers are moved away from each other when the bag is being twisted, to further tighten the bag.

Advantageously a slotted plate is inserted between the clamp and the pincers over the closed neck of the bag, which will hold back the bird when the bag is tightened. In this manner a relatively strong pulling force may be applied to the bag, so that the removal of all wrinkles is assured and the bottom of the bag is pulled tight against the bird.

The slotted plate is preferably so coupled with the clamp, that they rotate together when the bag is twisted. In this manner chafing of the bag against the edges of the plate, which might cause the bag to tear, is prevented.

Advantageously the abutment surface is adjustable, so that the distance between that surface and the slotted plate may be adapted to the size of the bags and the birds.

Preferably the number of turns made by the clamp when twisting the bag is adjustable, so that depending on the size of the birds and the bags, the bags may be optimally tightened without tearing.

In a very efficient embodiment of the apparatus according to the invention, the clamp, the slotted plate and the pincers are pivotably mounted, so that they may be swung away together when the bag is twisted, to a tieing unit which ties the bags with tape or a metal clip.

BRIEF DESCRIPTION OF THE DRAWINGS

Further objects, features and advantages of the invention will become apparent from the following description of an embodiment of the invention, taken in connection with the accompanying drawings in which.

DETAILED DESCRIPTION OF A PREFERRED EMBODIMENT

Figure 1:
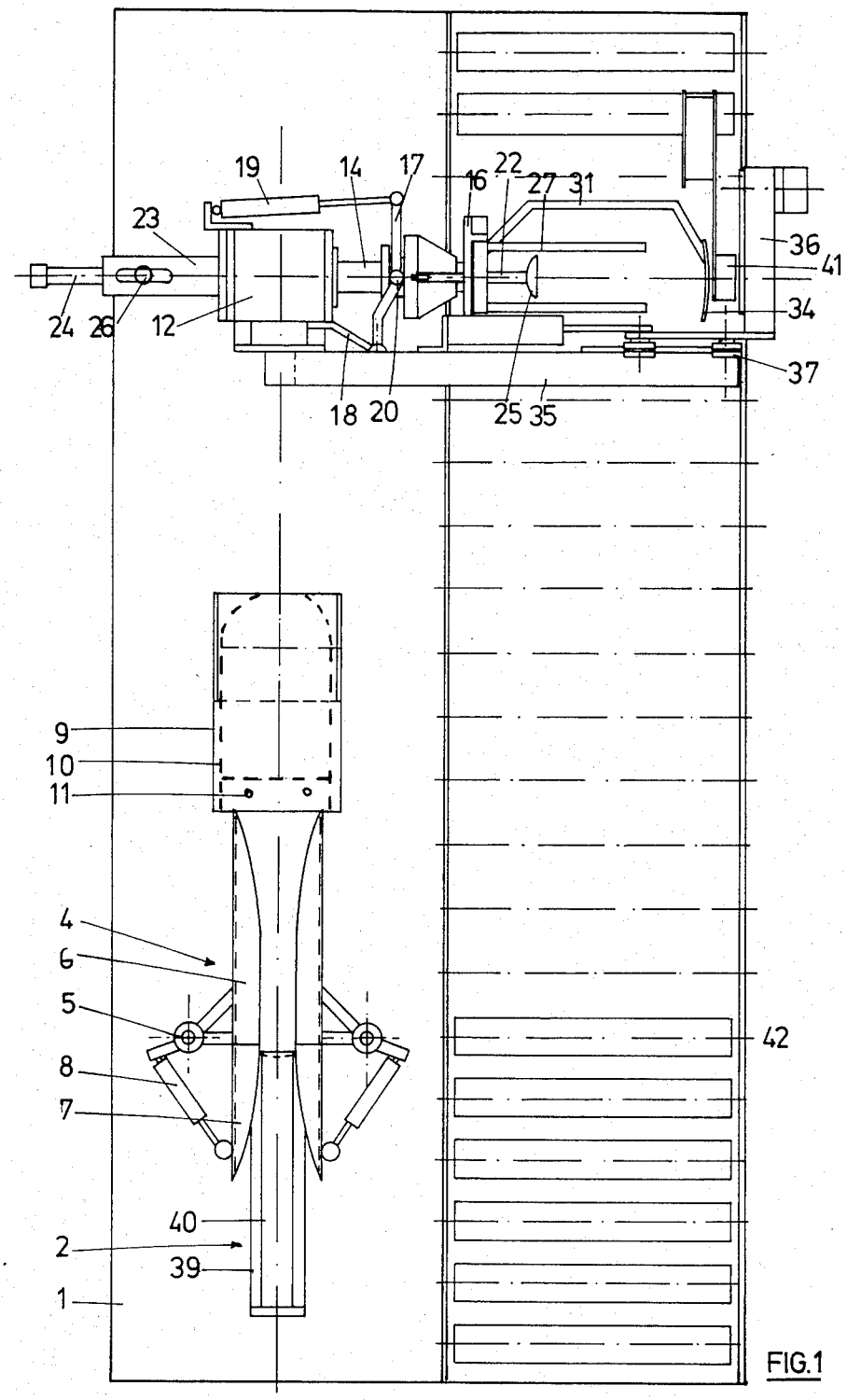
FIG. 1 is a top view of an apparatus according to the invention.

The apparatus shown in the drawings, which is for packing processed fowl in plastic bags, is provided with a frame with a table 1. On the table a plunger 2 is mounted, which is axially movable to and fro along guides mounted below the table surface, by means not shown, as indicated by the arrow 3 in FIG. 2. It will be understood that to enable this movement the table has been provided with an appropriate slot, which for the sake of clarity is not shown.

On the table is further mounted a funnel 4, the two symmetrical halves of which are each attached to a bracket 5, which is movable lengthwise as well as crosswise relative to the table. To this end each bracket 5 is laterally slidably attached to a slide block, which is longitudinally slidably mounted on guides below the table surface. The slots in the table top necessary for the movements of these brackets 5 are also not shown in the drawing.

Figure 2:
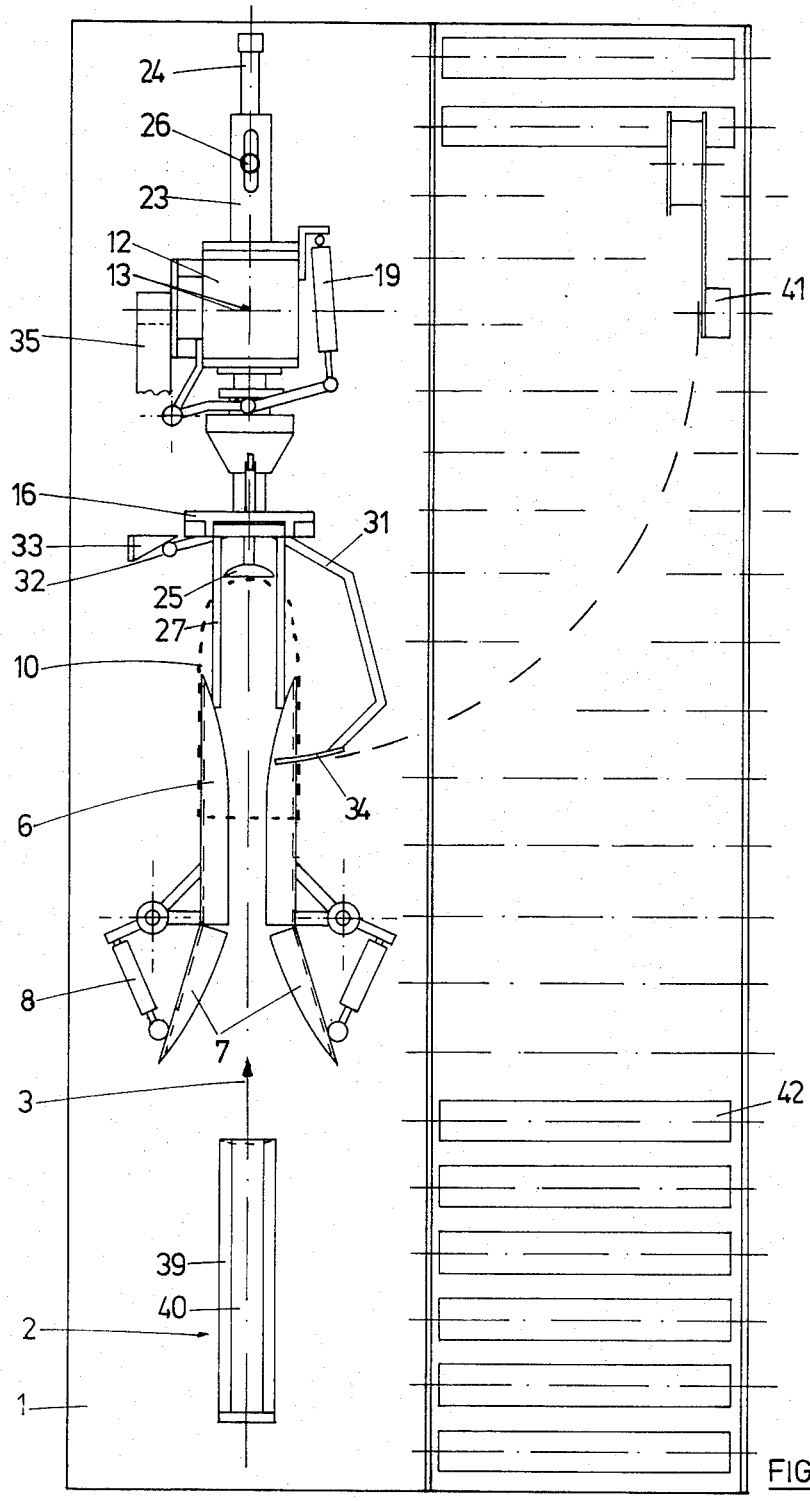
FIG. 2 is a top view of the apparatus shown in FIG. 1, in which certain parts are shown in a different position.

Each funnel half is made in two parts, namely a front part 6, which is rigidly attached to the corresponding bracket 5, and a rear part 7, which is pivotably connected to the same bracket 5. Between each of the rear parts 7 and the corresponding bracket 5 a pneumatic cylinder 8 is mounted, for moving the rear parts 7 between the extreme positions shown in FIGS. 1 and 2 respectively. In FIG. 1 the funnel 4 is shown in its fully retracted position, whereas FIG. 2 shows the funnel in its fully extended position.

A bag magazine 9 is sunken in the table 1, as is shown in FIG. 1 only. The magazine contains a stack of plastic bags 10, of the type normally used for packing birds, which are held on a pair of pins 11. Below the edge of the table 1 an air nozzle is mounted for blowing open the top most bag in the magazine.

Near the other end of the table a 90° gear box 12 is movably mounted, so that it may turn about a vertical axis 13. Below the table a drive unit is mounted, by means of which the gear box 12 can be moved between the two extreme positions shown in FIGS. 1 and 2 respectively. Also the motor, which drives the gear box 12 is mounted below the table 1.

A conical curve body 15 is slidably but not rotatably mounted on the hollow output shaft 14 of the gear box 12, and a pivot plate 16 is attached to the free outer end of the shaft 14. A forked lever 17 is pivotably connected to a bracket 18, which is attached to the gear box 12. Between the lever 17 and the gear box 12 a pneumatic cylinder 19 is mounted, so that when the cylinder is extended the curve body 15 is pushed along the shaft 14 by two rollers 20, which are attached to the lever 17 and bear in a curve track 21 in the curve body 15.

Within the hollow shaft 14 a slide bar 22 is mounted, which extends through the gear box 12 into a sleeve 23 attached to the gear box 12. A pneumatic cylinder 24 is mounted in the sleeve 23, for axially moving the slide bar 22. The free outer end of the slide bar 22 carries a saucer shaped abutment 25. The cylinder 24 is axially adjustable in the sleeve 23 by means of a set screw 26.

The pivot plate 16 supports a clamp 27, consisting of two forked arms 27, each pivotably connected to the pivot plate 16 by means of a hinge 28. The end 29 of each arm, which extends past the hinge 28, carries a follower roller 30 bearing on the curve body 15. The arm ends 29 are urged towards each other and pressed against the curve body 15 by a spring not shown in the drawings.

A slotted plate 34 is pivotably coupled and carried by the clamp 27 to move from a first position away from and out of contact with the bag so that the plunger 2 may enter the bag and to a second position wherein a slot formed in the plate is inserted over the end of the bag between the clamp 27 and the open edge of the bag. The means for pivoting the slotted plate comprises cam 33 and follower 32 that is connected to arm 31 carrying plate 34.

Figure 4:
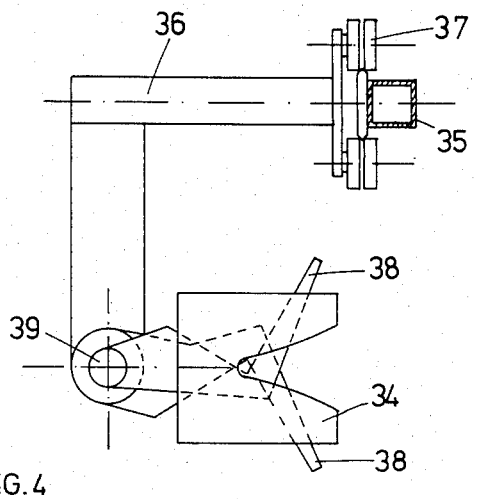
FIG. 4 is an enlarged front view of the pincers and the slotted plate for twisting the bag.
Figure 3:
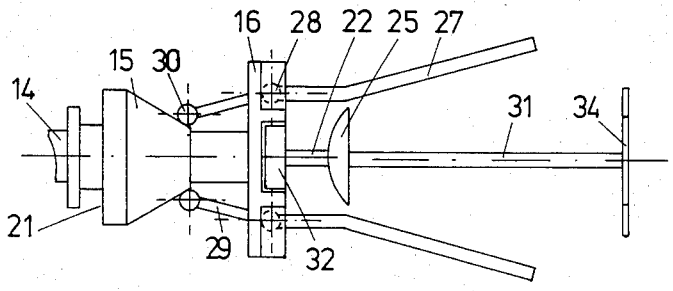
FIG. 3 is an enlarged side view of the clamp and the pivotable slotted plate for twisting the bag.

Finally another arm 35 is fixed to the gear box 12, which is fully shown in FIG. 1 but only partially visible in FIG. 2. A pincer support 36 is slidably mounted on the arm 35 by means of rollers 37, as is most clearly shown in FIG. 4. Between the support 36 and the arm 35 an air cylinder, which is not shown, is mounted for sliding the support 36 along the arm 35. The support 36 carries a pair of pincers 38, which are pivotably mounted on a shaft 39 attached to the support 36. Two air cylinders, which are not shown in the drawing, are provided to open and close the pincers 38.

The operation of the apparatus hereinbefore described is as follows: Starting from the position shown in FIG. 1, the two brackets 5 of the funnel 4 are moved towards each other, so that the two funnel halves are brought together and the funnel becomes narrow. Then the funnel 4 is moved forwards as a whole, so that the front parts 6 of the funnel 4 are inserted into the uppermost bag 10, which has been blown open in the magazine 9. Finally the two funnel halves are moved apart again so that the bag 10 is firmly held by the funnel 4. At the same time the rear parts 7 of the funnel are swung outwards by the air cylinders 8. The funnel now has the position shown in FIG. 2, and the gear box 12, together with all parts attached thereto, is swung also to the position shown in FIG. 2, in which the clamp 27 and the pincers 38 are opened, the slotted plate 34 is swung away, and the abutment surface 25 and the pincer support 36 are retracted towards the gear box 12. The position of the air cylinder 24 in the sleeve 23 has been so adjusted, that the bottom of the bag 10 on the funnel 4 is spaced from the abutment surface 25.

This now is the starting position for the operational cycle of the apparatus, which is controled by a suitable control unit installed under the table 1, and is started again for each bird by means of a push button.

First a bird to be packed is placed on its back with its legs away from the bag 10, between the rear parts 7 of the funnel 4 on the table 1 before the start button is pushed. The cycle of operations starts with closing the rear parts of the funnel 4 by the air cylinders 8. This brings the bird's legs together, so that they may be caught by the plunger 2, which is now moved forward.

By the plunger 2, which consists of two parts, namely a plank shaped lower plunger 39, which is moved forward first and comes to bear on the bird's behind directly over the tail, and a mainly cylindrical upper plunger 40, which is moved forward somewhat later, overtakes the lower plunger and comes to bear on the ends of the bird's legs, the bird is then pushed through the forward parts 6 of the funnel 4 into the bag 10. When the bird reaches the bottom of the bag 10, the bag is pulled off the funnel until the bag 10 comes to bear on the abutment surface 25. This causes the legs of the bird to be folded against its body by the upper plunger 40, so that finally the birds is positioned in the bag 10 as it were with its knees drawn up.

Next the funnel 4 is retracted to the position shown in FIG. 1, whereas the plunger remains extended. This causes the bag 10 to be pulled off the funnel 4 and tight over the bird. After this the cylinder 19 is extended, so that the conical curve body 15 is pushed towards the bird along the hollow shaft 14 and the clamp 27 is closed because the rollers 30 run up along the sloping curve body 15. The bird is now held in its bag 10 by the clamp 27, so that the legs cannot stretch out again when the plunger 2 is retracted. After withdrawal of the plunger the pincers 38 are closed, so that the open end of the bag is now closed and firmly gripped.

The gear box 12, together with the pivot plate 16 and the arm 35, is now moved from the position shown in FIG. 2 to the position shown in FIG. 1, so that the roller 32 is released from the abutment 33 and the slotted plate 34 attached to the arm 32, slides over the closed neck of the bag 10, between the clamp 27 and the pincers 38. The output shaft 14 of the gear box 12 then starts rotating, so that the bag 10 with the birds, together with the clamp 27 and the slotted plate 34 is rotated relative to the pincers 38 and the bag 10 is tightened and twisted. At the same time the pincer support 36 slides outward along the arm 35 and also the abutment surface 25 is extended. This abutment surface pushes the bird against the slotted plate 34 and the pincers pull the bag 10 tightly over the bird, which is held back by the slotted plate 34. The number of turns made by the pivot plate 16 is so adjusted that the bag 10 is optimally tightened, without tearing, depending on the size of the bird and the bag.

When the gear box has reached the position shown in FIG. 1, the bag 10 has been completely tightened while the bird and the bag 10 are still held by the clamp 27 and the pincers 38. The twisted end of the bag 10 is received in the beak of a tieing device, at the end of swinging movement of the gear box, as is shown in FIG. 1. This tieing device 41 ties the bag 10 with tape or a metal clip and cuts of the twisted end of the bag 10 at the desired length. In the meantime the next bag has been blown open and put onto the funnel, so that the apparatus is ready for packing the next bird at the moment the preceding bird is released by the clamp 27 and the pincers 38.

The released packed bird drops into a carton placed on a roller track 42 below the tieing device 41. This roller track may be attached to the frame of the apparatus. When the carton has been filled it is pushed down the roller track onto a cross conveyor, which takes the carton away.

In practice the packing machine will be wheeled so that it may be moved along a row of collecting bins, which are part of a weighing and sizing system The operator of the machine will take the birds to be packed out of these bins. When one bin is empty, the machine is wheeled to the next bin for packing another size of birds, after replacing the bags 10 in the magazine by bags of another size, and if necessary readjusting the position of the abutment surface 25 and the number of turns made by the shaft 14. The cross conveyors runs under the collecting bins and the table 1 is facing the bins with the narrow end where the plunger is situated.

It will be understood, that only a single embodiment of the invention was described in detail, and that within the scope of the invention a number of other embodiments are possible giving the same results.

I claim:

1. An apparatus for packing a bird in a plastic bag, a magazine holding said plastic bag, a funnel, one end of said funnel inserted into said bag previously opened by blown air, an abutment surface, plunger means pressing said bird into said bag and forcing said bird together with said bag against said abutment folding said bird's legs back against its body in said bag, means for tying said bag closed, the improvement comprising:

a support;

clamp means carried by said support for grasping and holding said bag after said bird has been pressed into said bag by said plunger means;

pincer means carried by said support for closing and holding the open end of said bag after said plunger means is removed from said bag;

means for rotating said bird and bag about the longitudinal axis of said bag along with said clamp means relative to said support and relative to said pincer means holding an end of bag for tightening and twisting said end of said bag prior to tying;

a tying station spaced from said clamp means including said means for tying and closing said twisted end of said bag about said fowl;

a slotted plate receivable over said closed end of said bag between said clamp means and said pincer means for holding back said bird as said bag is being twisted; and said slotted plate coupled to said clamp means whereby said slotted plate and said clamp means are rotated together with the bag to reduce chaffing of said bag.

2. The apparatus as set forth claim 1 further comprising:

means for moving said clamp means and said pincer means away from each other longitudinally on said support when said bag is being twisted.

3. The apparatus as set forth in claim 1 further comprising:

said slotted plate pivotably carried by said support having a first position away from and out of contact with said bag to permit entry of said plunger into said bag and a second position wherein a slot in said plate is inserted over said closed end of said bag between said clamp means and said pincer means for holding back said bird as said bag is being twisted.

4. The apparatus as set forth in claim 3 further comprising:

means for adjusting positioning of said abutment surface relative to said slotted plate so that the distance between said abutment surface and said slotted plate may be adapted to the size of said bags and said birds.

5. The apparatus as set forth in claim 1 further comprising:

means for adjusting the number of revolutions made by said clamp when twisting said bag.

6. The apparatus as set forth in claim 1 further comprising:

means for rotating said support laterally to said tying station while said bag is being twisted so that said bag may be tied.

7. An apparatus for packing a bird in a plastic bag, a magazine holding said plastic bag, a funnel, one end of said funnel inserted into said bag previously opened by blown air, an abutment surface, a plunger means pressing said bird into said bag and forcing said bird together with said bag against said abutment folding said bird's legs back against its body in said bag, means for tying said bag closed, the improvement comprising:

a support;

clamp means carried by said support for grasping and holding said bag after said bird has been pressed into said bag by said plunger means;

pincer means carried by said support for closing and holding the open end of said bag after said plunger means is removed from said bag;

means for rotating said bird and bag about the longitudinal axis of said bag along with said clamp means relative to said support and relative to an end of said bag being held by said pincer means for tightening and twisting said end of said bag prior to tying;

a tying station including said means for tying and closing said twisted end of said bag about said fowl; and a single slotted plate pivotably carried by said clamp, means to move said plate away from a first position away from and out of contact with said bag so said plunger may enter said bag and to a second position wherein a slot formed in said plate is inserted over said closed end of said bag between said clamp means and said pincer means, and said slotted plate is positioned adjacent said bird in said second position to bear against said bird in the direction of said longitudinal axis when said abutment is actuated to push said bird against said slotted plate, thereby allowing said bag to be pulled tightly over said bird as said end of said bag is being twisted.

* * * * *